US012065895B2

(12) United States Patent
Larbi Zeghlache

(10) Patent No.: US 12,065,895 B2
(45) Date of Patent: Aug. 20, 2024

(54) PASSIVE LOGGING WHILE LEVITATING (PLWL): CONTACTLESS CONVEYANCE

(71) Applicant: SAUDI ARABIAN OIL COMPANY, Dhahran (SA)

(72) Inventor: Mohamed Larbi Zeghlache, Al Khobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/048,323

(22) Filed: Oct. 20, 2022

(65) Prior Publication Data

US 2024/0133257 A1 Apr. 25, 2024
US 2024/0229584 A9 Jul. 11, 2024

(51) Int. Cl.

| | |
|---|---|
| ***E21B 23/00*** | (2006.01) |
| ***E21B 23/10*** | (2006.01) |
| ***E21B 47/022*** | (2012.01) |
| ***E21B 47/095*** | (2012.01) |
| ***E21B 47/10*** | (2012.01) |
| ***E21B 49/00*** | (2006.01) |

(52) U.S. Cl.
CPC ..... *E21B 23/001* (2020.05); *E21B 23/10* (2013.01); *E21B 47/022* (2013.01); *E21B 47/095* (2020.05); *E21B 47/10* (2013.01); *E21B 49/00* (2013.01)

(58) Field of Classification Search
CPC ..... E21B 23/001; E21B 23/10; E21B 47/022; E21B 47/10; E21B 49/00
See application file for complete search history.

(56) References Cited

U.S. PATENT DOCUMENTS 6,378,627 B1 * 4/2002 Tubel ..... E21B 17/1078 166/255.2
6,843,317 B2 1/2005 Mackenzie
(Continued)

FOREIGN PATENT DOCUMENTS

CN 103590809 A 2/2014

OTHER PUBLICATIONS

M. S. Chowdhury et al.; "Production Logging and its Implementation: A Technical Review", International Journal of Petroleum and Petrochemical Engineering (IJPPE); vol. 5; Issue 2; 2019; pp. 42-51 (10 pages).

(Continued)

*Primary Examiner* — Christopher J Sebesta
*Assistant Examiner* — Yanick A Akaragwe
(74) *Attorney, Agent, or Firm* — Osha Bergman Watanabe & Burton LLP

(57) ABSTRACT

A method for logging in a well is disclosed. The method includes securing a passive logging while levitating (PLWL) assembly to a bottomhole assembly (BHA) to form a logging assembly and running the logging assembly into a wellbore of the well. The method further includes detecting a deviation in the wellbore, detecting a fluid flow direction around the logging assembly in the wellbore, activating the PLWL assembly based, at least in part, on the deviation in the wellbore and the fluid flow direction, and levitating the logging assembly in a center of the wellbore. The method also includes determining whether the logging assembly has reached a target depth and performing logging in the well while the logging assembly is levitating in the center of the wellbore.

17 Claims, 8 Drawing Sheets

(56) References Cited

U.S. PATENT DOCUMENTS

| | | | | |
|---|---|---|---|---|
| 2006/0202685 | A1 | 9/2006 | Barolak et al. | |
| 2010/0154531 | A1* | 6/2010 | Han | E21B 47/085 73/152.47 |
| 2013/0214934 | A1* | 8/2013 | Smart | E21B 47/103 340/854.3 |
| 2015/0354301 | A1 | 12/2015 | Al Dabbous | |
| 2016/0369620 | A1 | 12/2016 | Pelletier et al. | |
| 2018/0126813 | A1 | 5/2018 | Park | |
| 2019/0368331 | A1* | 12/2019 | Vick, Jr. | E21B 41/00 |
| 2020/0240263 | A1 | 7/2020 | Sherrit et al. | |
| 2020/0392803 | A1 | 12/2020 | Zhao et al. | |
| 2021/0054728 | A1 | 2/2021 | Fellinghaug et al. | |
| 2021/0381369 | A1 | 12/2021 | Jackson et al. | |
| 2023/0128181 | A1* | 4/2023 | McCormick | E21B 23/001 73/152.54 |

OTHER PUBLICATIONS

Notification of Transmittal of the International Search Report and the Written Opinion of the International Searching Authority issued in corresponding International Application No. PCT/US2022/051709, mailed Mar. 27, 2023 (13 pages).

Office Action issued in the counterpart U.S. Appl. No. 17/457,578, mailed on Feb. 7, 2023 (16 pages).

* cited by examiner

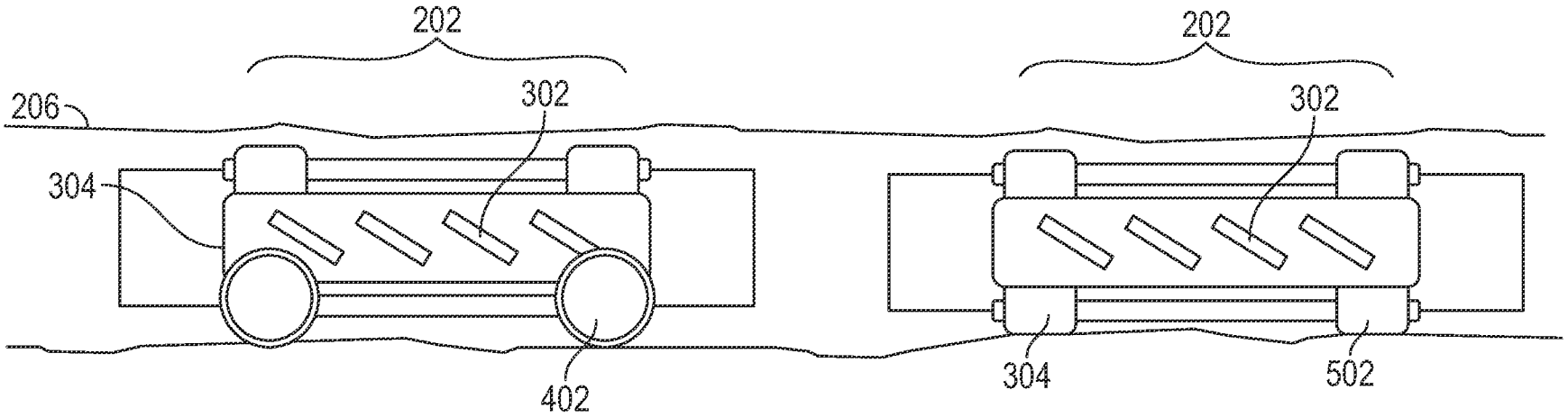
FIG. 5A
FIG. 5B
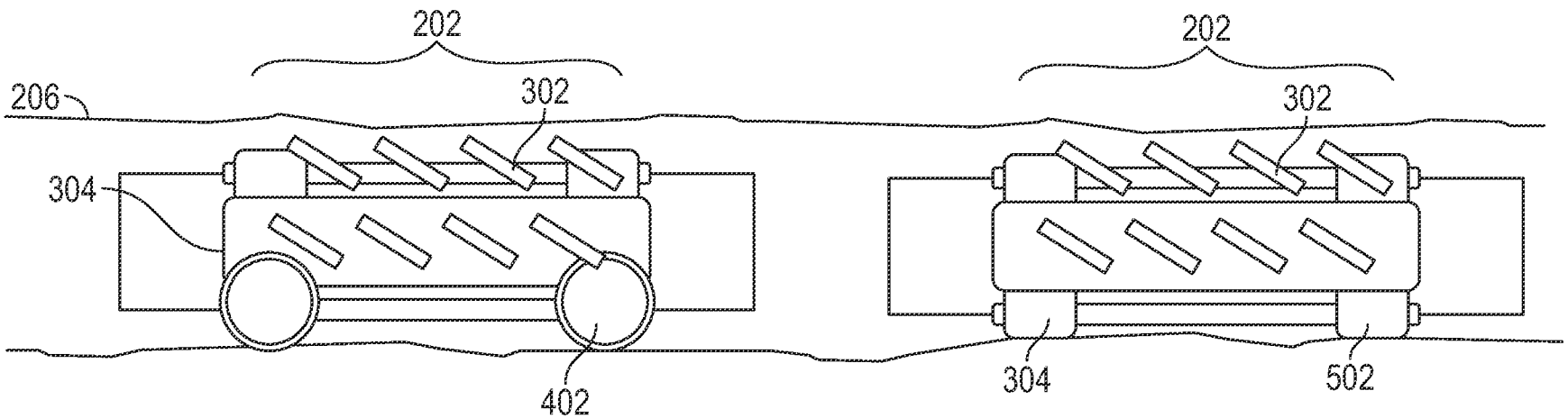
FIG. 5C
FIG. 5D

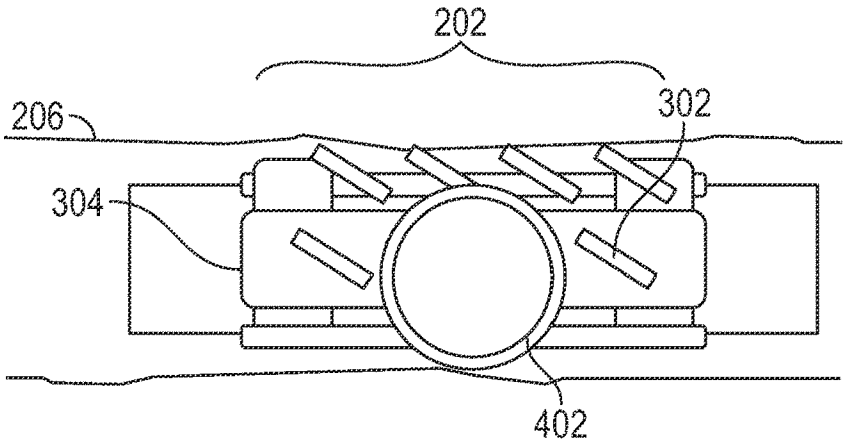
FIG. 5F
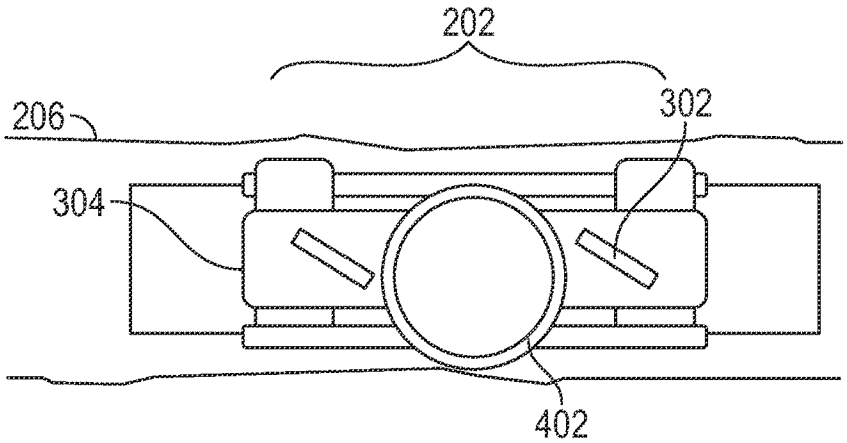
FIG. 5E
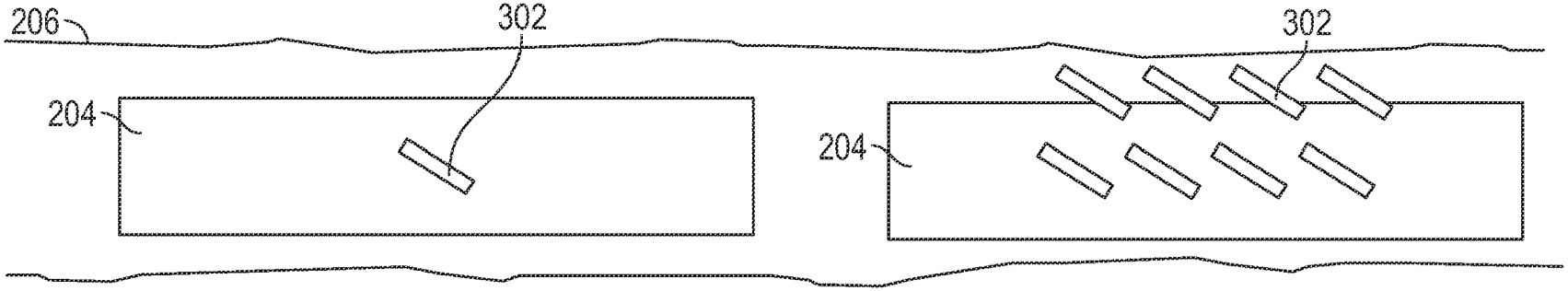
FIG. 5H
FIG. 5G

PASSIVE LOGGING WHILE LEVITATING (PLWL): CONTACTLESS CONVEYANCE

BACKGROUND

In the oil and gas industry, logging refers to the assessment of formation properties through the use of tools attached to a bottomhole assembly. Logging may be performed during the drilling of the well, as well as during the production and intervention stages. As such, logging may be performed in both an open-hole environment and a cased-hole environment. Logging is typically performed via one or more tools, which are directed down a wellbore by a conveyance method. Depending on the complexity of the well profile for downhole application or pipeline installation for surface application, many conveyance techniques exist to overcome challenges related to operation, safety, quality, and cost. In oil and gas wells, the choice of a given conveyance technique depends on many parameters, which may include well condition, borehole size, total depth, well profile, deviation, dog-leg severity, restriction, and completion, in addition to other unmentioned methods. Additionally, the required logging or intervention equipment to be run in the well and whether data is needed to stream in real-time or in memory mode can also influence the selection of a conveyance method.

Conveyance methods can be classified as tethered or untethered. Tethered conveyance may refer to all methods that provide direct mechanical connection or electrical connection or both to the logging and intervention tools from the surface equipment. Untethered conveyance refers to methods of transporting logging tools downhole without means for a mechanical or electrical connection to the surface equipment.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method for logging in a well. The method may include securing a passive logging while levitating (PLWL) assembly to a bottomhole assembly (BHA) to form a logging assembly and running the logging assembly into a wellbore of the well. The method may further include detecting a deviation in the wellbore, detecting a fluid flow direction around the logging assembly in the wellbore, activating the PLWL assembly based, at least in part, on the deviation in the wellbore and the fluid flow direction, and levitating the logging assembly in a center of the wellbore. The method may also include determining whether the logging assembly has reached a target depth and performing logging in the well while the logging assembly is levitating in the center of the wellbore.

In another aspect, embodiments disclosed herein relate to a method for logging in a well. The method may include securing a passive logging while levitating (PLWL) assembly to a bottomhole assembly (BHA) and running the PLWL assembly and the BHA into the well to a start depth. The method may also include orienting a plurality of wings disposed on the PLWL assembly to a neutral position, where the neutral position is characterized as being parallel to the BHA and reading a deviation of the well at a depth of the BHA.

In yet another aspect, embodiments disclosed herein relate to an assembly for logging in a well. The assembly may include a tool body disposed within a wellbore within the well, and one or more wheels, where the one or more wheels create a wheeled carriage on which the tool body may be disposed, and where the one or more wheels are configured to contact the wellbore. The assembly may also include an orienting sub disposed on the tool body, a fluid flow direction sensor disposed on the tool body, and a plurality of wings disposed on the tool body. The assembly may be configured to levitate in a center of the well and to perform logging while levitating in the well. Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The size and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

FIGS. 5A-5H show wing arrangements on a PLWL assembly in accordance with one or more embodiments.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology.

Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-8, any component described with regard to a figure, in various embodiments disclosed herein, may be equivalent to one or more like-named components described with regard to any other figure. For brevity, descriptions of these components may not be repeated for each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

In one aspect, embodiments disclosed herein relate to a passive logging while levitating (PLWL) assembly which may operate in any downhole environment, including open-hole and cased-hole environments, which may refer to a cased section of a well with tubing or casing, or inside surface pipelines.

Figure 1:
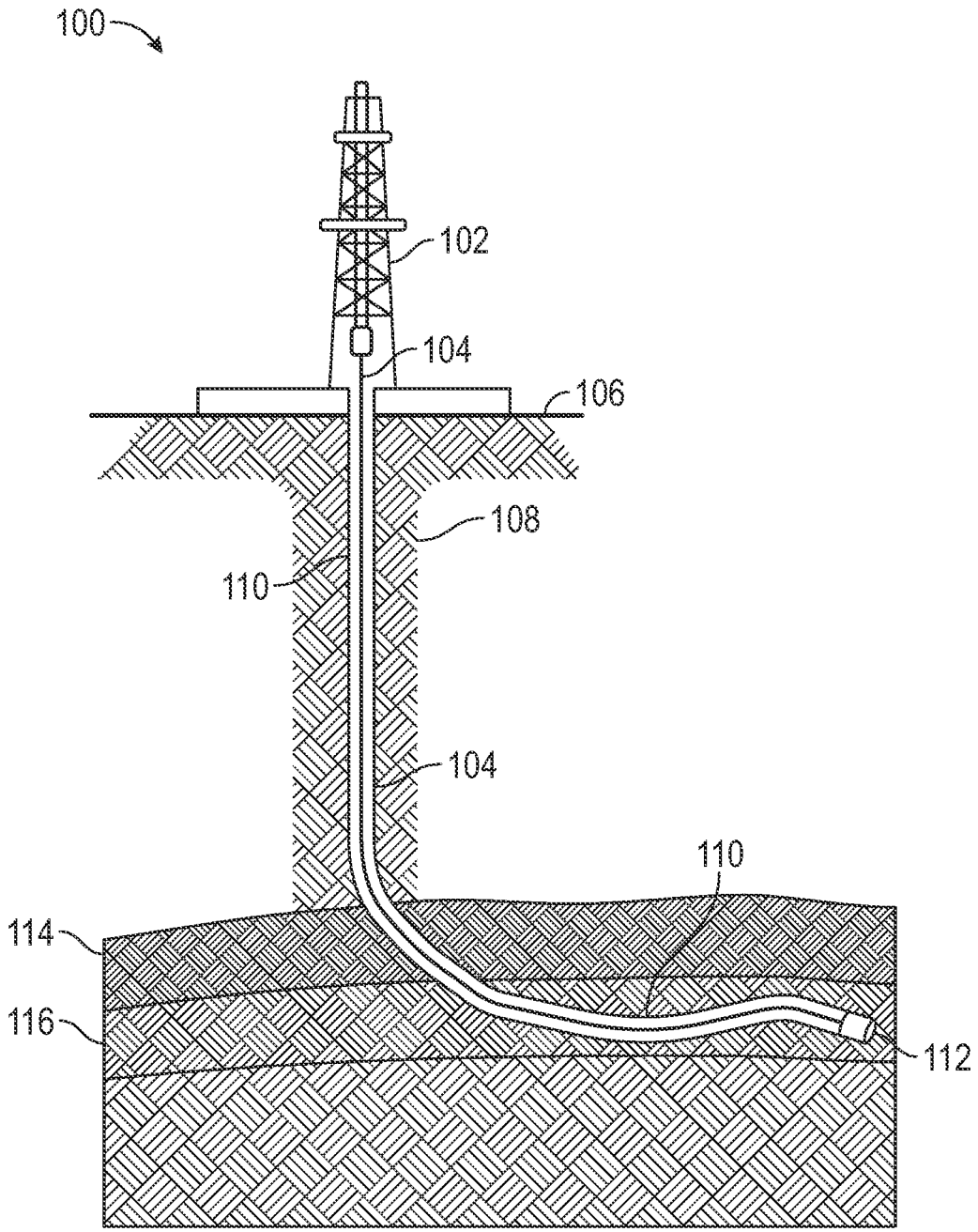
FIG. 1 shows an exemplary production system in accordance with one or more embodiments.

FIG. 1 illustrates an exemplary well (100) in accordance with one or more embodiments. As shown in FIG. 1, a well path (110) may be drilled by a drill bit (112) attached by a drill string (104) to a drill rig (102) located on the surface of the earth (106). The well may traverse a plurality of overburden layers (108) and one or more cap-rock layers (114) to a hydrocarbon reservoir (116). The well path (110) may be a curved well path, or a straight well path. In one or more embodiments, the well path (110) may be described as vertical, deviated, horizontal, or extended reach drilling (ERD). One skilled in the art will be aware that deviated, horizontal, and ERD wells are considered to be complex.

In one or more embodiments, logging, with the aid of conveyance methods, may be performed in the exemplary well (100). Typical logging operations are conducted during open hole drilling operations or if the well has open hole completion. However, logging may also occur in cased-hole wells, particularly in the production and intervention stages. For example, logging for the purpose of cement evaluation is conducted in a cased-hole environment. Further, some open hole wells also have cased-hole sections. The purpose of conveyance methods is to provide a safe and efficient way to take logging and intervention tools to a target depth, which, in some embodiments, may be a total depth. References to total depth herein may refer to the depth at which drilling is stopped, and therefore the depth of the bottom of the wellbore. For vertical wells, it is straightforward to use any type of line as a conveyance method. For example, a line may refer to wireline, slickline, or fiberline. However, the definition herein of a line is not meant to be limiting and a line may refer to any method of mechanically or electrically connecting a logging apparatus to the surface equipment of a well. As well complexity increases, the required equipment and procedure for conveyance becomes inherently more costly and complicated, with two particular challenges being lock depth due to high drag and friction, and sensor position that is biased by the weight of the tools and conveyance system. Embodiments disclosed herein provide for a solution for logging operations in complex wells where both challenges are addressed and overcome simultaneously.

Figure 2:
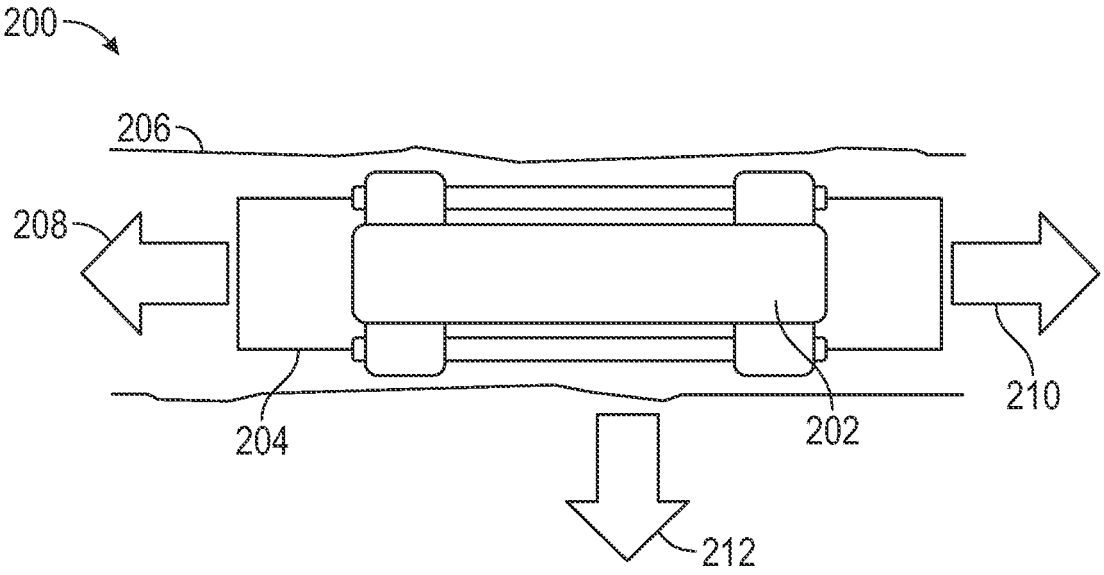
FIG. 2 shows a logging assembly in accordance with one or more embodiments.

Turning to FIG. 2, FIG. 2 shows a logging assembly in accordance with one or more embodiments. The logging assembly (200), in accordance with one or more embodiments, may include a passive logging while levitating (PLWL) assembly (202) disposed around a bottomhole assembly (BHA) (204). In one or more embodiments, the BHA (204) may be run into a wellbore (206). In one or more embodiments, the wellbore (206) may be uncased, creating an open-hole environment. However, there are also embodiments in which the wellbore (206) may be cased, or where metallic or non-metallic downhole pipes or surface pipes are used within the wellbore (206). Though the wellbore (206) is shown in a horizontal configuration, it should be understood that the wellbore (206) may be any orientation (vertical, horizontal, or deviated) without departing from the scope of this disclosure.

In one or more embodiments, as the logging assembly (200) moves through the wellbore (206), a number of forces may act upon it. In one or more embodiments, a thrust force (208) may act to push the BHA (204) into the wellbore. The thrust force (208) may also be referred to as a run-in-hole (RIH) force, when the logging assembly (200) is being run into the wellbore (206), or as a pull-out-of-hole (POOH) force, when the logging assembly (200) is being removed from the wellbore (206). A drag force (210) may act in opposition to the thrust force (208). Gravity (212) may act in a downward direction. In one or more embodiments, the PLWL assembly (202) may assist in pushing the BHA (204) further through a deviated or horizontal well section before or beyond the lock depth without any additional or external thrust forces (208). Further, the PLWL assembly (202) may use wellbore fluids to reduce forces acting in opposition to the logging assembly's (200) motion.

Figure 3:
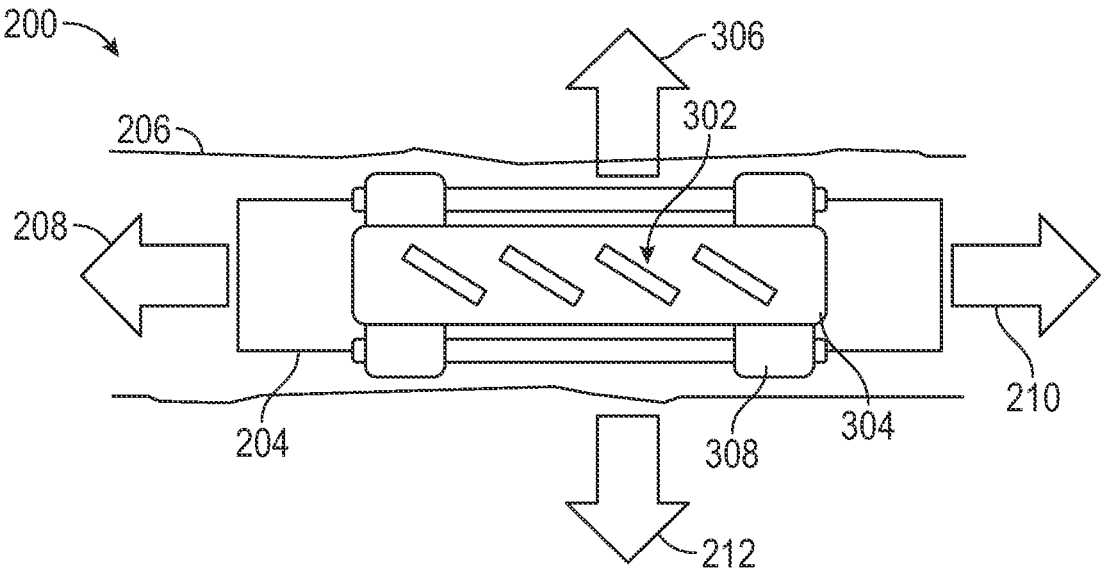
FIG. 3 shows a logging assembly in accordance with one or more embodiments.

Turning to FIG. 3, FIG. 3 shows a logging assembly (200) in accordance with one or more embodiments. The PLWL assembly (202) may have a plurality of wings (302) disposed along the tool body (304). In one or more embodiments, the plurality of wings (302) may be arranged laterally and/or longitudinally around the tool body (304). In one or more embodiments, the plurality of wings (302) may be tilted at a specific angle to provide a lift force (306) which may act in opposition to gravity (212). The lift force (306) may enable the logging assembly (200) to levitate in the center of the wellbore (206).

A minimum lift force (306) may occur when the thrust force (208) is higher than the sum of the opposing drag force (210). A minimum speed required to generate the minimum lift force (306) may vary based on the BHA (204) and downhole conditions. For example, the minimum speed may vary depending on the weight and shape of the BHA (204) (i.e., the hydrodynamics of the BHA (204)). Additionally, the minimum speed may vary depending on the relative fluid flow direction with respect to the BHA (204) movement. For example, there may be static flow, production flow or injection flow within the wellbore (206), and the BHA (204) may be run into the wellbore (206) or pulled out of the wellbore (206). Further, fluid properties, such as fluid density, viscosity, rheology, or solid content, may also contribute to determining the minimum speed.

Wellbore (206) conditions may also contribute to developing a model which may be used to determine the required minimum speed to produce the required minimum lift force (306). For example, in open hole conditions, rugosity, caving, washouts, and breakouts may all be incorporated into a model. Similarly, in cased holes and pipelines, scale buildup within the casing and/or pipelines may be incorporated into the model. Well shape and profile may also be factored into the model as a part of the effective drag force (210) acting on the logging assembly (200). Once the model is completed with all required wellbore (206) conditions and BHA (204) properties, the model may be used by an operator to determine a minimum speed which can produce the desired minimum lift force (306).

In one or more embodiments, the orientation of the wings (302) may be adjusted according to the direction of movement of the BHA (204). For example, if the BHA (204) is moving down through a deviated or horizontal well section, the wings (302) may be oriented up. Conversely, if the BHA (204) is moving up through a deviated or horizontal well section, the wings (302) may be oriented down.

In one or more embodiments, the orientation the wings (302) may also be adjusted according to both fluid flow direction and BHA (204) direction. In situations where fluid injection occurs while the BHA (204) is RIH, both the BHA (204) and the fluid are directed downwards. In these embodiments, the wings (302) may also be oriented downwards. There may be embodiments in which fluid production occurs while the BHA (204) is RIH, where the BHA (204) is directed downwards, and fluid direction is upwards. In these embodiments, the wings (302) may be oriented upwards. In some embodiments, fluid injection may occur while the BHA (204) is POOH, such that the fluid may flow downwards while the BHA (204) may move upwards. In these embodiments, the wings (302) may be oriented downwards. Further, there may also be embodiments in which fluid production occurs while the BHA (204) is moving upwards. In these embodiments, the wings (302) may be oriented upwards.

In one or more embodiments, the logging assembly (200) may have one or more contact points (308) which may contact the wellbore (206). The contact points (308) may be wheels, rollers, or any other type of wheeled carriage without departing from the scope of this disclosure. The contact points (308) may serve to minimize friction between the tool body (304) and the wellbore (206).

Figure 4:
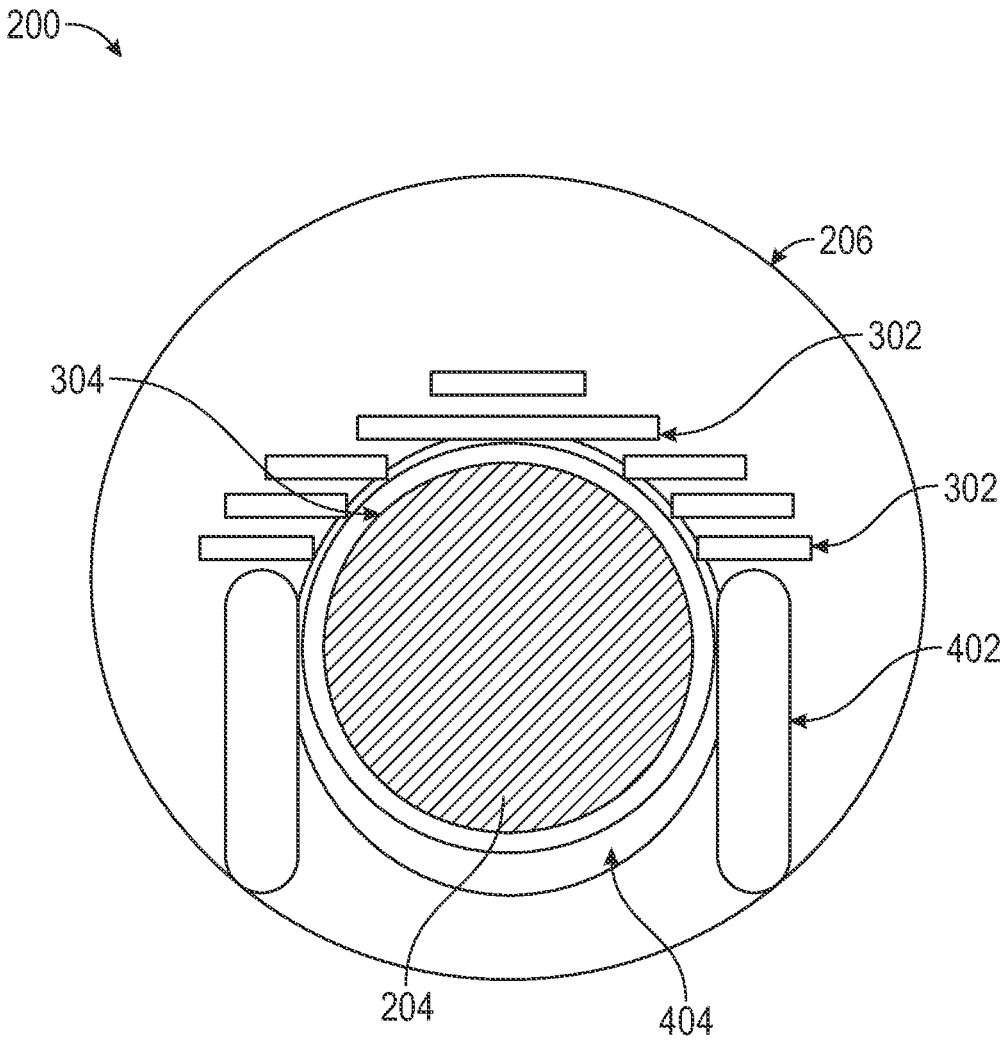
FIG. 4 shows a cross-sectional view of a logging assembly in accordance with one or more embodiments.

FIG. 4 shows a cross-sectional view of a logging assembly (200) in accordance with one or more embodiments. As illustrated, the tool body (304) may be hollow, such that the BHA (204) may fit concentrically within the confines of the tool body (304). The logging assembly (200) may have two wheels (402) disposed on either axial side of the tool body (304). In one or more embodiments, the wheels (402) may contact a lower portion of the wellbore (206). The logging assembly (200) may also have a plurality of wings (302) positioned around the tool body (304). In one or more embodiments, the plurality of wings (302) may be arranged in layers on an outer surface of the tool body (304). An optimization process may be performed to determine the number, size, position, shape, material, and coating of each of the plurality of wings (302). In one or more embodiments, each of the plurality of wings (302) may be a flat surface, however there are other possible shapes which may be utilized to achieve higher performance. For example, the wings (302) may be any shape which may cause deflection of fluid flow within the wellbore (206), which may initiate the lift force (306).

The logging assembly (200) may also have an orienting sub (404) which may assist in maintaining the logging assembly (200) in a correct orientation within the wellbore (206). For example, the orienting sub (404) may shift the center of gravity of the logging assembly (200) to ensure that the wheels (402) contact the lower portion of the wellbore (206). In one or more embodiments, the orientation of the PLWL assembly (202) may be altered independently or dependently of the orientation of the BHA (204). In embodiments in which the orientation of the PLWL assembly (202) is altered independently, the PLWL assembly (202) and the BHA (204) may be considered to be mechanically independently, such that the orienting sub (404) may rotate to a required position without rotating the BHA (204). In embodiments in which the orientation of the PLWL assembly (202) is altered dependently, the entire logging assembly (200) may be rotated to face downwards (i.e., so that the wheels (402) contact the wellbore (206)) below a certain well deviation.

FIGS. 5A-5H show PLWL assemblies in accordance with one or more embodiments. More specifically, FIGS. 5A-5I highlight the versatility of the logging assemblies in terms of the number and positioning of the wings (302) and the wheels (402).

FIG. 5A shows a PLWL assembly (202) in accordance with one or more embodiments. In this embodiment, the PLWL assembly (202) may have two wheels (402) spaced along each side of the tool body (304), such that there are four wheels (402) in total attached to the tool body (304). Further, the PLWL assembly (202) may have four wings (302) spaced equally along the axial length of the tool body (304).

FIG. 5B shows a PLWL assembly (202) which may also have four wings (302) spaced equally along the axial length of the tool body (304). However, in place of wheels (402), embodiments in accordance with FIG. 5B may have one or more contact points directly between the tool body (304) and the wellbore (206).

FIGS. 5C and 5D show PLWL assemblies (202) with two rows of wings (302) spaced equally along the axial length of the tool body (304). In one or more embodiments, the first row of wings (302) may be stacked directly over the second row of wings (302). However, there may be some embodiments in which the rows are offset, such that the wings (302) are staggered. As shown in FIG. 5C, some embodiments may pair two rows of wings (302) with two wheels (402) positioned to contact the wellbore (206). However, there are other embodiments, as shown in FIG. 5D, in which rollers (502) may be used to create a contact point between the tool body (304) and the wellbore (206).

FIG. 5E shows a PLWL assembly (202) which may utilize one large wheel (402) disposed on either side of the tool body (304) as contact points between the tool body (304) and the wellbore (206). There may be two wings (402) arranged on either side of the large wheel (402) in a single row.

Turning now to FIG. 5F, FIG. 5F shows a PLWL assembly (202) with two rows of wings (302) arranged along the axial length of the tool body (304). In some embodiments, a large wheel (402) may be used as the contact point between the tool body (304) and the wellbore (206). In such embodiments, the first row may extend fully across the entire axial length of the tool body (304). The second row, positioned below the first row, may include a number of wings (302) spaced around the large wheel (402). In one or more embodiments, the second row may contain less wings (302) than the first row.

In one or more embodiments, as shown in FIGS. 5G and 5H, the plurality of wings (302) may be built in and secured directly to the BHA (204). The shape of each of the wings (302) may be similar to gill openings. In one or more embodiments, there may be a single row of wings (302), as shown in FIG. 5G, or two rows of wings (302), as shown in FIG. 5H. Embodiments such as those depicted in FIGS. 5G and 5H, where the wings (302) are built in to the BHA (204)

and where there is no PLWL assembly (202) may be preferable in middle sections of the BHA (204) where no tool body (304) or standoff is required or planned.

Those skilled in the art will appreciate that the components and arrangements shown in FIGS. 5A-5H, including the number of wings, shape, material, etc. are just indicative and may vary without departing from the scope disclosed herein.

Figure 6:
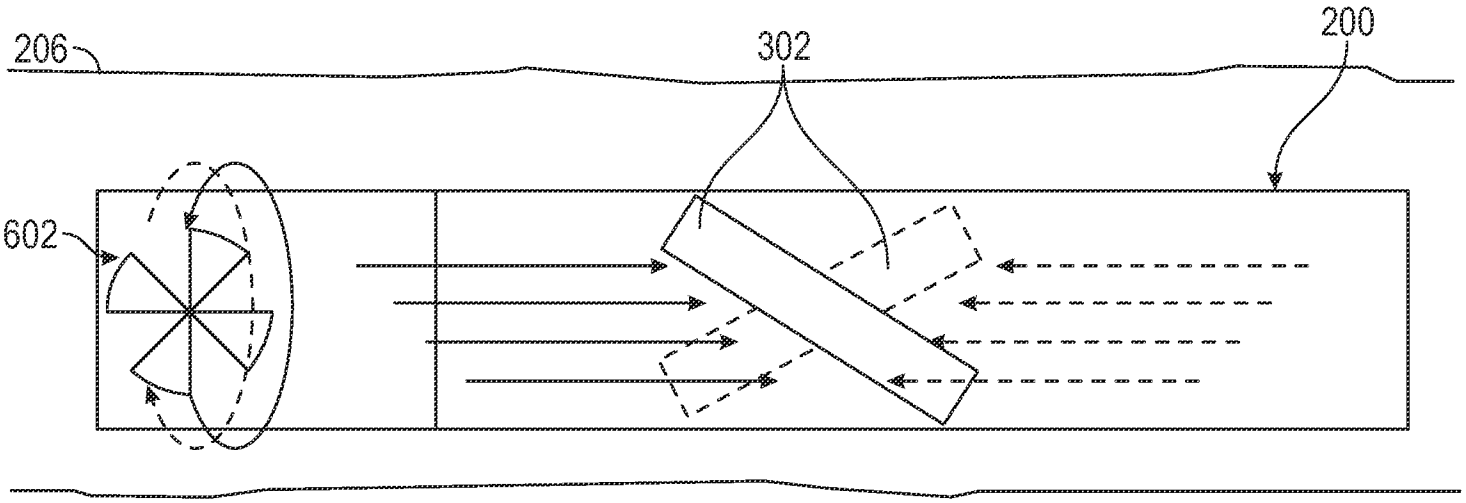
FIG. 6 shows a PLWL assembly in accordance with one or more embodiments.

FIG. 6 shows a logging assembly in accordance with one or more embodiments. In one or more embodiments, a spinner (602) may be disposed on the logging assembly (200). A spinner (602), or another detection device, may be used to detect fluid flow direction and to adjust the orientation of the wings (302) accordingly. The spinner (602) may allow for the wings (302) to be oriented downwards (shown by the solid-lined wing) in some embodiments or for the wings (302) to oriented upwards (shown by the dashed-line wing) in other embodiments.

Use of a spinner (602) allows for autonomous control of the logging assembly (200) while downhole. In one or more embodiments, the spinner (602) may be positioned anywhere along the logging assembly (2002) in any configuration. In other embodiments, the spinner (602) may be independent of the logging assembly (200). For example, in such embodiments, the spinner (602) may be an additional sub which may connect to the BHA (204). The spinner (602) may be electrically and mechanically connected to the other tools and may provide input in order to control the orientation of the wings (302).

Figure 7:
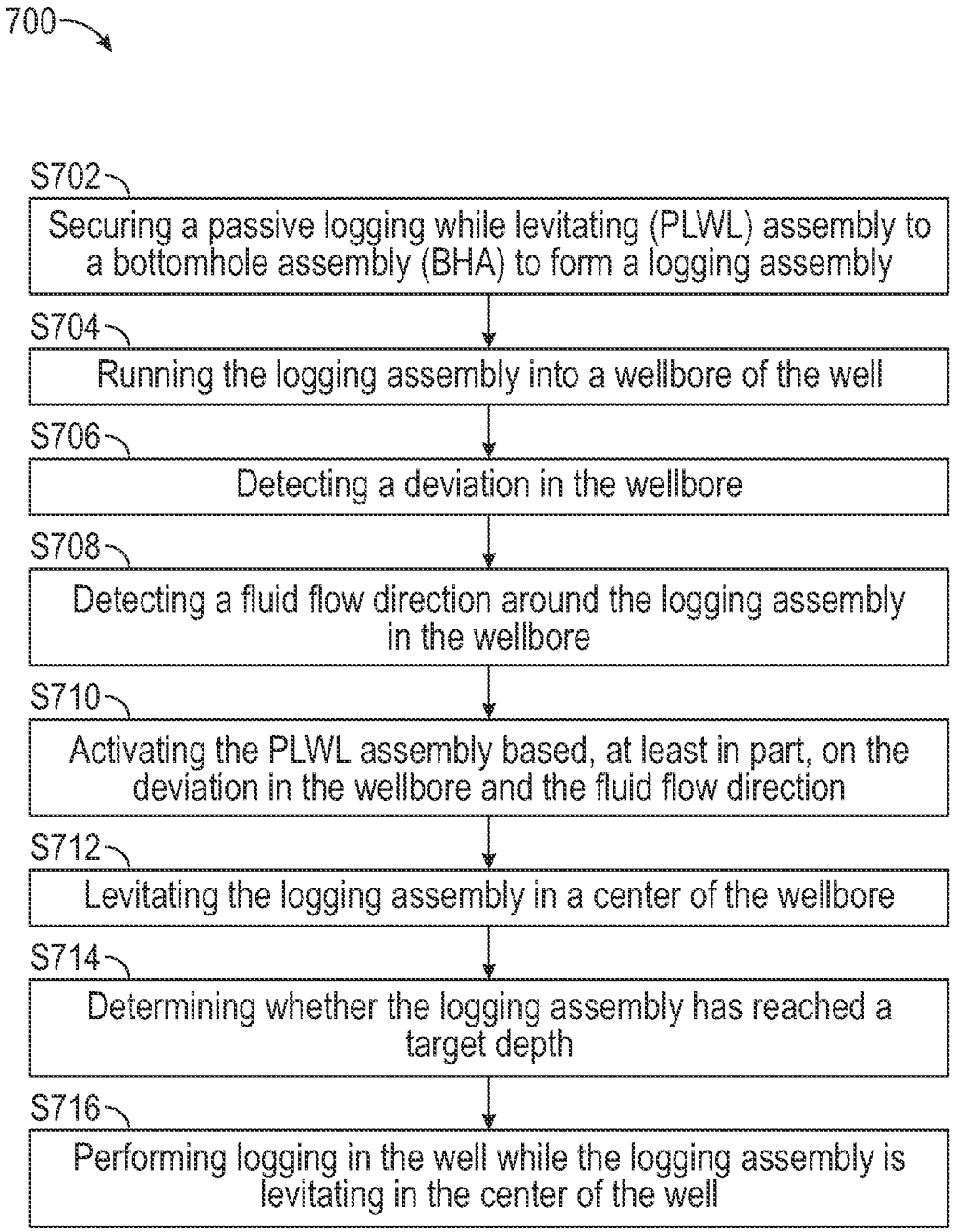
FIG. 7 shows a flowchart of a method in accordance with one or more embodiments.

FIG. 7 shows a flowchart for a method of logging while levitating in accordance with one or more embodiments. More specifically, FIG. 7 depicts a flowchart (800) of a method for passively levitating a logging assembly (200) and maintaining the LWL assembly's position in the center of a wellbore (206). FIG. 7 may apply to both tethered and untethered conveyance methods. Further, one or more blocks in FIG. 7 may be performed by one or more components as described in FIGS. 1-6. While the various blocks in FIG. 7 are presented and described sequentially, one of ordinary skill in the art will appreciate that some or all of the blocks may be executed in different orders, may be combined, may be omitted, and some or all of the blocks may be executed in parallel. Furthermore, the blocks may be performed actively or passively.

Initially, a passive logging while levitating (PLWL) assembly (202) may be secured to a bottomhole (BHA) assembly (204) to form a logging assembly (200), S702. In one or more embodiments, the PLWL assembly (202) may slide over the BHA assembly (204). However, there are other embodiments in which the PLWL assembly (202) may be provided in two or more pieces which may be secured around the BHA (204). There are also additional embodiments in which the PLWL assembly (202) may be built into the BHA (204). The logging assembly (200) may be run into the wellbore (206) of the well, S704. In one or more embodiments, the well may be vertical, deviated (or slightly deviated), or horizontal. As such, the deviation, if any, of the wellbore (206) may be detected, S706. Any commercially available sensor may be used to detect wellbore (206) deviation without departing from the scope of this disclosure. Further, a fluid flow direction around the logging assembly (200) may also be detected, S708. In one or more embodiments, a spinner (602) may used to detect the fluid flow direction. However, any flow detection sensor may be used without departing from the scope of this disclosure.

The PLWL assembly (202) may be activated based, at least in part, on the deviation of the wellbore (206) and the fluid flow direction, S710. In one or more embodiments, activating the PLWL assembly (202) may include adjusting the orientation of a plurality of wings (302) disposed on the PLWL assembly (202) based on the deviation in the wellbore (206) and the fluid flow direction. Adjusting the orientation of the plurality of wings may refer to increasing or decreasing the angle of each of the plurality of wings (302). Adjusting the orientation of the plurality of wings (302) may causing a deflection of fluid flow in the wellbore (206) and initiating a lift force (306) on the logging assembly (200). The logging assembly (200), using the lift force (306), may then levitate in the center of the wellbore (206), S712.

The method may also include determining whether the logging assembly (200) has reached a target depth, S714. Determining whether a target depth has been reached may be achieved by measuring a position of the BHA (204) within the wellbore (206). In one or more embodiments, the position of the BHA (204) in the wellbore (206) may be measured with an ultrasonic caliper. Once the target depth has been reached, logging may be performed in the wellbore (206) while the logging assembly (200) is levitating in the center of the wellbore (206), S716.

The method depicted in flowchart 700 includes detecting the deviation in the wellbore (206), changing the angle of each of the plurality of wings (302), and levitating the logging assembly (200) in the center of the wellbore (206). The method may further include detecting a vertical orientation of the wellbore (206). Once a vertical orientation, or a lack of wellbore (206) deviation, is detected, the plurality of wings (302) may be returned to a neutral position. In one or more embodiments, the neutral position may refer to the original positioning of the wings (302), such that the wings (302) are not angled.

The method depicted in flowchart 700 may also include determining if the BHA (204) is moving in an opposite direction to the fluid flow direction. If the BHA (204) is moving in a direction opposite to the fluid flow direction, the angle of each of the plurality of wings (302) may be changed. In addition, the method may include determining if a fluid flow rate is greater than a threshold value. If the fluid flow rate is greater than a threshold value, the angle of each of the plurality of wings (302) may be changed. Altering the angle of each wing (302) may deflect the fluid flowing in the wellbore (206), creating a lift force (306) which may induce levitation of the logging assembly (200) in the center of the wellbore (206).

Figure 8:
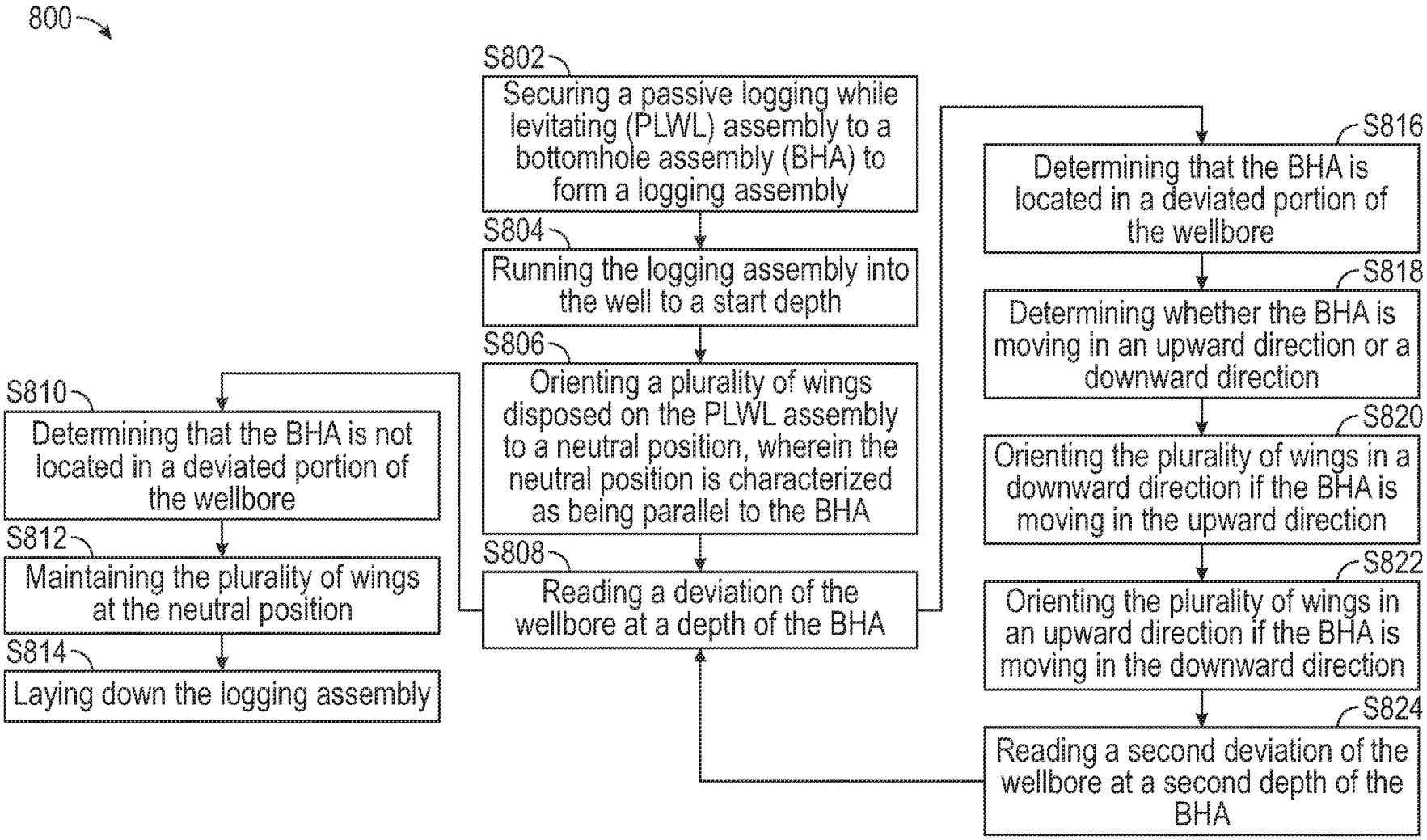
FIG. 8 shows a flowchart of a method in accordance with one or more embodiments.

FIG. 8 shows a flowchart for a method of logging while levitating in accordance with one or more embodiments. More specifically, FIG. 8 depicts a method (800) for passively levitating a logging assembly (200) and maintaining the LWL assembly's position in the center of a wellbore (206). FIG. 8 may apply to both tethered and untethered conveyance methods. Further, one or more blocks in FIG. 8 may be performed by one or more components as described in FIGS. 1-6. While the various blocks in FIG. 8 are presented and described sequentially, one of ordinary skill in the art will appreciate that some or all of the blocks may be executed in different orders, may be combined, may be omitted, and some or all of the blocks may be executed in parallel. Furthermore, the blocks may be performed actively or passively.

Initially, a passive logging while levitating (PLWL) assembly (202) may be secured to a bottomhole (BHA) assembly (204) to form a logging assembly (200), S802. In one or more embodiments, the PLWL assembly (202) may slide over the BHA assembly (204). In yet other embodiments, the PLWL assembly (202) may be provided in two or more pieces which may be secured around the BHA (204). There are also additional embodiments in which the PLWL assembly (202) may be built into the BHA (204). The logging assembly (200) may be run into the wellbore (206) of the well to a start depth, S804. Once the logging assembly has reached the start depth, the wings (302) disposed on a tool body (304) of the PLWL assembly (202) may be oriented to a neutral position, S806. In one or more embodiments, the neutral position may be characterized as the wings (302) extending parallel to the BHA (204).

A deviation of the wellbore (206) may be read at the depth of the BHA (204), S808. Any commercially available sensor may be used to detect wellbore (206) deviation without departing from the scope of this disclosure. If it is determined that the BHA (204) is not located in a deviated portion of the wellbore (206), the wings (302) may be maintained at the neutral position, S810, S812. The logging assembly (200) may then be laid down, S814. In one or more embodiments, 'laying down' the logging assembly (200) may refer to the process by which the wings (302) are confirmed to be in a neutral position prior to disassembling of the BHA (204).

If the BHA (204) is located in a deviated portion of the wellbore (206), it may be determined if the BHA (204) is moving in an upward direction or a downward direction, S816, S818. The method may also include detecting a fluid flow direction with a fluid flow direction sensor disposed on the PLWL assembly. In one or more embodiments, fluid flow may be in an upward direction during a production operation or in a downward direction during an injection operation.

If the BHA (204) is moving in an upward direction, the wings (302) disposed on the tool body (304) of the PLWL assembly (202) may be oriented in a downward direction, S820. If the BHA (204) is moving in a downward direction, the wings (302) may be oriented in an upward direction, S822. The deviation of the wellbore (206) may then be read again. In one or more embodiments, repeating the deviation reading may determine if there has been a change, and if so, may allow for adjustment of orientation of the wings (302).

In one or more embodiments, the wings (302) may also be adjusted based on whether the BHA (204) is moving in a direction opposite to the fluid flow direction. In one or more embodiments, the fluid flow direction may be assessed using a flow direction sensor. For example, if the BHA (204) is moving opposite to the fluid flow direction, the wings (302) may be oriented in an upward direction. In the same manner, if the BHA (204) is moving in the same direction as the fluid flow direction, the wings (302) may be oriented in a downward direction.

Adjusting the orientation of the wings (302) may allow for deflection of wellbore fluids, such that a lift force (306) is generated. The lift force (306) in accordance with one or more embodiments, may cause levitation of the logging assembly (200) in the center of the wellbore (206).

In one or more embodiments, a fluid flow rate and a BHA (204) eccentricity may also be measured. In one or more embodiments, fluid flow rate may be measured using a flowmeter and eccentricity may be measured using a mechanical or ultrasonic caliper. In one or more embodiments, the eccentricity may be estimated using a calibrated result from fluid flow direction, fluid flow rate, BHA (204) parameters, and wellbore (206) parameters.

There may be a flow rate threshold, which may be predetermined. The flow rate threshold, in one or more embodiments, may depend on the position of the BHA (204) within the wellbore (206), which is determined by measuring the eccentricity of the logging assembly (200). The flow rate threshold may refer to the fluid flow rate at which the logging assembly (200) is at an acceptable position within the wellbore (206) in order to appropriately levitate the logging assembly (200) in the center of the wellbore (206).

If the measured fluid flow rate is greater than the flow rate threshold, the deviation of the wellbore (206) may be determined again. In situations where the fluid flow rate is greater than the threshold, the lift force (306) may exceed the required magnitude to levitate the logging assembly (200) in the center of the wellbore. Instead of levitating the logging assembly (200) in the center of the wellbore (206), the excessive lift force (306) may cause the logging assembly (200) to contact an upper side of the wellbore (206), creating additional friction. Fluid flow rate may be greater than the threshold in embodiments with a high production or injection rate and a relatively light logging assembly (200).

In a system where fluid flow direction, fluid flow rate, and eccentricity are measured, the system may be adaptive in that the angle of the wings (302) may be a function of the downhole parameters. Adjusting the angle of the wings (302) more precisely, rather than orienting the wings (302) at a fixed upward direction or a fixed downward direction, allows for control of the lift force (306) generated to position the logging assembly (200) at an optimum position within the wellbore (206). Such an adaptive system may be particularly beneficial in active deployment systems, such as tractoring systems or autonomous downhole robots, where maintaining the logging assembly (200) in an optimum position is vital for safely deploying and retrieving toolstrings.

Embodiments of the present disclosure may provide at least one of the following advantages. In general, intervention and logging tools are subject to drag and friction forces which halt progress within the wellbore at the lock depth, which can be predicted with simulation software based on well information, toolstring information, and conveyance method. For example, wireline conveyance is relatively quick to deploy and provides precise depth control and a high bandwidth for real-time data telemetry. However, in horizontal and deviated wells, such methods result in a relatively shallow lock depth since frictional forces increase as deviation increases. Borehole rugosity, breakouts, and washouts can also increase the difficulty in reaching deeper depths.

In contrast, embodiments of the present invention eliminate friction and drag by levitating, or intermittently levitating, the entire bottomhole assembly (or parts of the bottomhole assembly). Levitating the bottomhole assembly and corresponding PLWL assembly allows for the maintenance of the BHA in an optimum position, allowing for the safe deployment and retrieval of the assembly. This may reduce wear on the BHA, the PLWL assembly, and logging tools. Reduction in wear may reduce maintenance and frequency of required tool or assembly replacement. Further, use of the PLWL assembly in conjunction with the BHA may extend the reach depth beyond what would be possible with standard conveyance methods. Positioning of the BHA at an optimum position within the wellbore may also position sensors optimally, allowing for improved data quality.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed:

1. A method for logging in a well, comprising:

securing a passive logging while levitating (PLWL) assembly to a bottomhole assembly (BHA) to form a logging assembly;

running the logging assembly into a wellbore of the well;

detecting a deviation in the wellbore;

detecting a fluid flow direction around the logging assembly in the wellbore;

activating the PLWL assembly based, at least in part, on the deviation in the wellbore and the fluid flow direction, wherein activating the PLWL assembly comprises adjusting an orientation of a plurality of wings disposed on the PLWL assembly based, at least in part, on the deviation in the wellbore and the fluid flow direction;

levitating the logging assembly in a center of the wellbore;

determining whether the logging assembly has reached a target depth; and performing logging in the well while the logging assembly is levitating in the center of the wellbore, wherein adjusting the orientation of the plurality of wings comprises causing a deflection of fluid flow in the wellbore and initiating a lifting force on the logging assembly.

2. The method of claim 1, wherein adjusting the orientation of the plurality of wings comprises increasing or decreasing an angle of each of the plurality of wings.

3. The method of claim 2, further comprising:

detecting the deviation in the wellbore;

changing the angle of each of the plurality of wings;

detecting a vertical orientation of the wellbore; and returning the plurality of wings to a neutral position.

4. The method of claim 2, further comprising:

determining if the BHA is moving in an opposite direction to the fluid flow direction;

changing the angle of each of the plurality of wings;

determining if a fluid flow rate is greater than a threshold value; and changing the angle of each of the plurality of wings.

5. The method of claim 1, wherein detecting the fluid flow direction comprises using a flow direction sensor to assess the fluid flow direction.

6. The method of claim 1, further comprising measuring a position of the BHA in the wellbore with an ultrasonic caliper.

7. A method for logging in a well, comprising:

securing a passive logging while levitating (PLWL) assembly to a bottomhole assembly (BHA) to form a logging assembly;

running the logging assembly into the well to a start depth;

orienting a plurality of wings disposed on the PLWL assembly to a neutral position, wherein the neutral position is characterized as being parallel to the BHA;

reading a deviation of the well at a depth of the BHA;

determining that the BHA is located in a deviated portion of the well;

determining whether the BHA is moving in an upward direction or a downward direction;

orienting the plurality of wings in a downward direction if the BHA is moving in the upward direction;

orienting the plurality of wings in an upward direction if the BHA is moving in the downward direction; and reading a second deviation of the well at a second depth of the BHA.

8. The method of claim 7, further comprising:

determining that the BHA is not located in a deviated portion of the well;

maintaining the plurality of wings at the neutral position; and laying down the PLWL assembly and the BHA.

9. The method of claim 7, further comprising detecting a fluid flow direction with a fluid flow direction sensor disposed on the PLWL assembly.

10. The method of claim 7, wherein a fluid flow may be in an upward direction during a production operation or in a downward direction during an injection operation.

11. An assembly for logging in a well, comprising:

a tool body disposed within a wellbore within the well;

one or more wheels, wherein the one or more wheels create a wheeled carriage on which the tool body may be disposed, and wherein the one or more wheels are configured to contact the wellbore;

an orienting sub disposed on the tool body;

a fluid flow direction sensor disposed on the tool body; and a plurality of wings disposed on the tool body, wherein an orientation of each of the plurality of wings is configured to change angle based, at least in part, on a deviation in the wellbore and a fluid flow direction, wherein the assembly is configured to levitate in a center of the well, wherein the assembly is configured to perform logging while levitating in the well, and wherein adjusting the orientation of the plurality of wings comprises causing a deflection of fluid flow in the wellbore and initiating a lifting force on the logging assembly.

12. The assembly of claim 11, wherein the well is selected from a group consisting of open-hole, cased-hole, metallic downhole or surface pipes, and non-metallic downhole or surface pipes.

13. The assembly of claim 11, wherein the wellbore is deviated or horizontal.

14. The assembly of claim 11, wherein the plurality of wings is positioned laterally or longitudinally around the tool body.

15. The assembly of claim 11, wherein the plurality of wings is configured to deflect fluid flow in the wellbore.

16. The assembly of claim 11, wherein the orientation of each of the plurality of wings is configured to change angle based, at least in part, on a fluid flow rate.

17. The assembly of claim 11, wherein the orienting sub is configured to adjust a center of gravity of the assembly based, at least in part, on the deviation of the wellbore.

* * * * *